United States Patent [19]

Duester et al.

[11] Patent Number: 4,759,480

[45] Date of Patent: Jul. 26, 1988

[54] GARMENT HANGER WITH AUXILIARY BAR

[75] Inventors: Everett L. Duester, Zeeland; John H. Batts, Grand Rapids, both of Mich.

[73] Assignee: Batts, Inc., Zeeland, Mich.

[21] Appl. No.: 60,464

[22] Filed: Jun. 11, 1987

[51] Int. Cl.[4] ..... A47G 25/36; A47G 25/48

[52] U.S. Cl. ..... 223/96; 223/91; 223/93; 211/45; 211/113; D6/315; D6/326; D6/327

[58] Field of Search ..... 223/91, 93, 96; D6/315, D6/326, 327; 211/45, 113

[56] References Cited

U.S. PATENT DOCUMENTS

| | | | |
|---|---|---|---|
| D. 222,513 | 10/1971 | Hart et al. | D6/315 |
| D. 224,670 | 8/1972 | Hart | D6/327 |
| D. 225,151 | 11/1972 | Hart | D6/326 |
| 2,970,726 | 2/1961 | Brooke | 223/96 |
| 3,157,325 | 11/1964 | Schefer | 223/91 |
| 3,165,245 | 1/1965 | Levine et al. | 223/91 |
| 3,350,754 | 11/1967 | Ballenger et al. | 223/96 X |
| 3,744,685 | 7/1973 | Hart | 223/96 |
| 3,767,092 | 10/1973 | Garrison et al. | 223/96 |

*Primary Examiner*—Robert R. Mackey

*Attorney, Agent, or Firm*—Price, Heneveld, Cooper, DeWitt & Litton

[57] ABSTRACT

A plastic hanger for articles including garments has article gripping clamps and is provided with an auxiliary bar over with portions of the articles or garments can be draped. The auxiliary bar depends below the hanger and is wider than the spacing between the outer ends of the clamps. The bar can be a separate component pivotally supported by the hanger body or it can be molded as an integral part of the hanger.

7 Claims, 2 Drawing Sheets

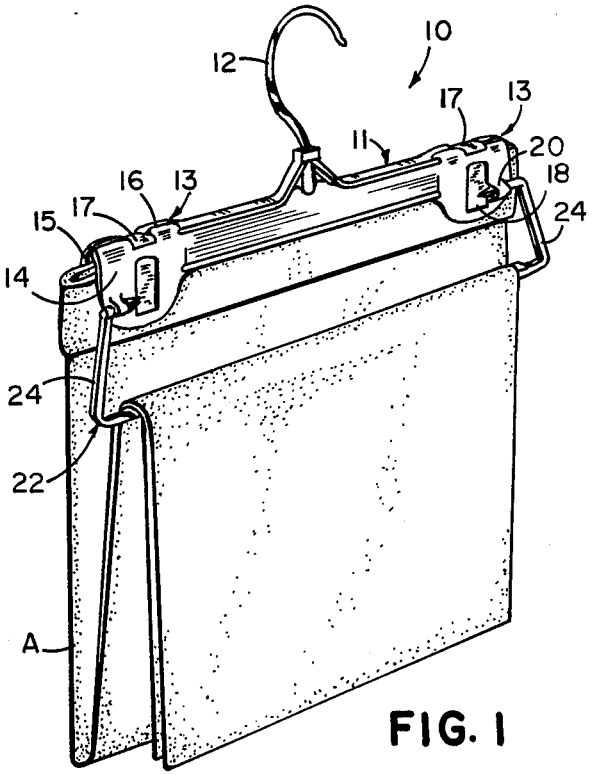
FIG. 1
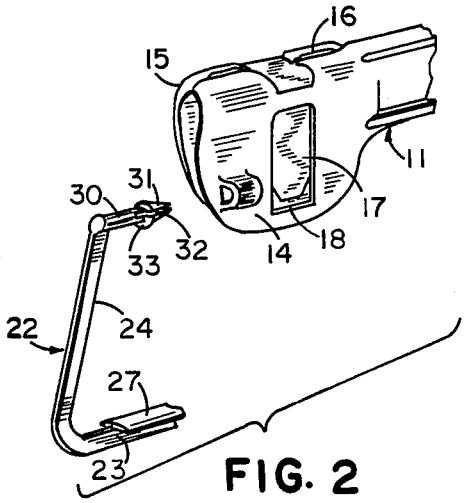
FIG. 2
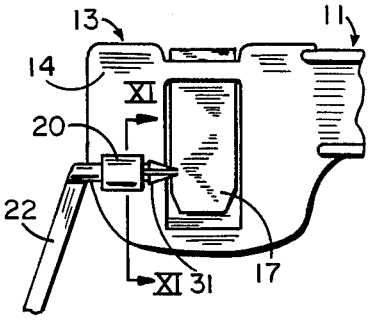
FIG. 4
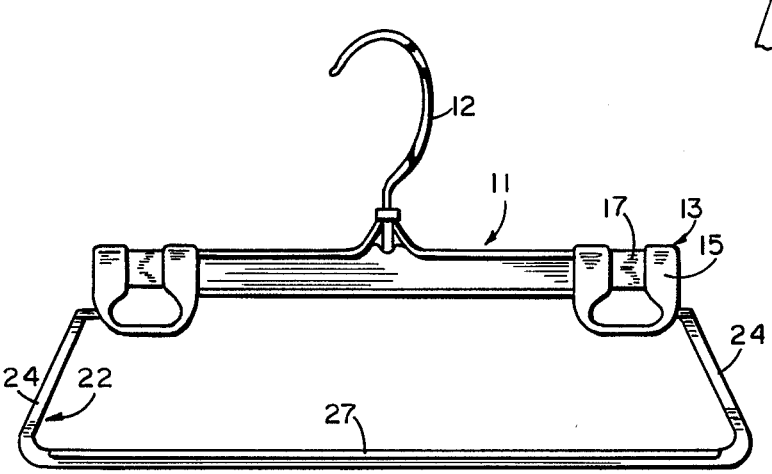
FIG. 3
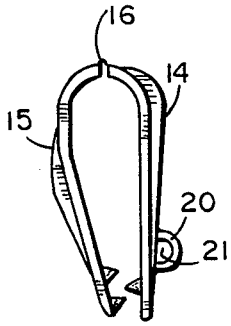
FIG. 5
FIG. 11
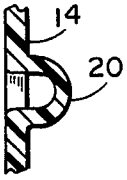

GARMENT HANGER WITH AUXILIARY BAR

FIELD OF THE INVENTION

This invention relates to display hangers, particularly intended to display articles which can be folded to accommodate their length while presenting an attractive display.

BACKGROUND OF THE INVENTION

It has long been recognized that hangers are a particularly effective means for displaying many types of articles. While for many years the use of hangers was confined to the clothing field, in recent years it has come to be recognized that hangers, if appropriately designed, can be very effective tools for display of various types of merchandise. However, in the case of certain types of merchandise, the hanger has to or should be modified to best perform its function as a display tool. Thus, the hanger must take into account the shape of the article involved and also how that article is best displayed to the potential customer and without the expenditure of a unreasonable amount of time and effort on the part of the merchant's personnel in properly positioning the article on the hanger. It is important that the hanger be durable because they do not necessarily receive careful handling by store personnel. It is also important that their cost be kept reasonable in light of the service they perform for the user.

BRIEF DESCRIPTION OF THE INVENTION

The invention utilizes a molded plastic hanger body of the type long known in the clothing merchandising field and described in U.S. Pat. No. 3,767,092 entitled GARMENT CLAMPING HANGER WITH SLIDABLE LOCKING CLIP issued Oct. 23, 1973 to Judd F. Garrison and John H. Batts. The hanger described in U.S. Pat. No. 3,767,092 is particularly designed for displaying articles, such as, slacks, shorts, skirts and the like. However, in the case of a number of other types of merchandise, the merchandise is too long to be simply hung from a conventional hanger, especially if the hanger is supported at a convenient height. Also, it is frequently desirable that the article be displayed in such a way that it occupies less vertical space so that several tiers of articles can be displayed in the same vertical arrangement. While it is particularly designed for articles other than clothing, it will be recognized that a hanger involving this invention can be used for displaying garments such as slacks. To reduce the vertical space required to display a single article, the hanger is provided with an auxiliary bar which is permanently or temporarily secured to the hanger body and over which one end of the article can be folded or draped. Thus, it has the advantage of making the display compact, yet, capable of displaying the article at full length simply by unfolding the article from the bar without completely disengaging it from the hanger. One end of the article remains clamped to the hanger, preventing inadvertent complete separation. This makes it simple and easy to return the article to its folded position when it is desired to rehang the display in its original form. It is within the concept of this invention that the auxiliary bar be formed integrally with the hanger body fabricated as a separate component. Further, its width should be substantially longer than that of the hanger to accommodate articles, the portion of which passes over the auxiliary bar, is significantly wider than the main body of the hanger. Examples of such articles are towels, particularly beach towels, drapes, curtains, wall paper samples and floor runners, to name a few.

BRIEF DESCRIPTION OF THE DRAWINGS

FIG. 1 is an oblique rear view of a hanger equipped with this invention over which an article has been draped;

FIG. 2 is an exploded, fragmentary rear view of a modified construction for the hanger of this invention;

FIG. 3 is a front elevation view of the hanger illustrated in FIGS. 1 and 2;

FIG. 4 is a fragmentary rear view of the auxiliary bar illustrated in FIG. 2, secured to the hanger body;

FIG. 5 is an end view of the hanger clip;

FIG. 11 is a fragmentary sectional view taken along the plane XI—XI of FIG. 4.

DESCRIPTION OF THE PREFERRED EMBODIMENT

Figure 6:
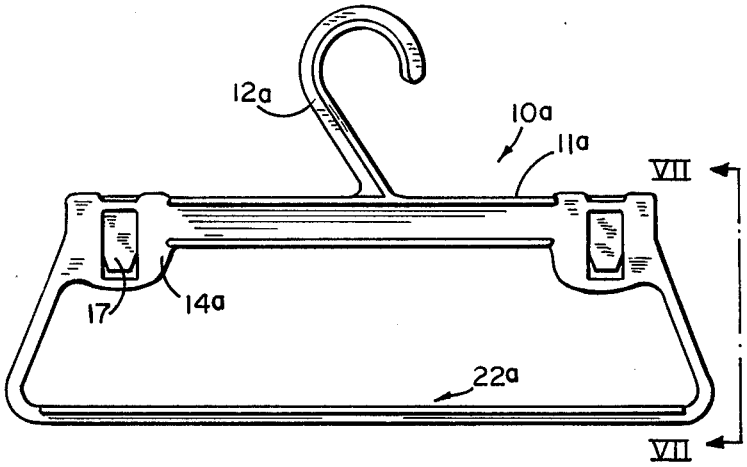
FIG. 6 is a rear elevation view of a further modified construction for the hanger.
Figure 7:
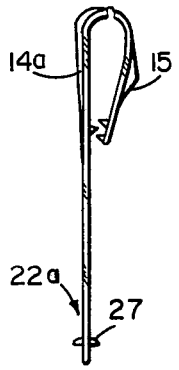
FIG. 7 is an end elevation view taken along the plane VII—VII of FIG. 6.

Referring to FIGS. 1, 2 and 3, the numeral 10 refers to a hanger having a one-piece, molded plastic body 11 supported at its center by a hook 12. While the hook 12 is illustrated as fabricated of wire and secured to the molded plastic body, it is within the scope of this invention that the hook could be molded integral with the body without in any way departing from the principles of this invention as, for example, illustrated in FIG. 6.

At each end, the body 11 is provided with a clamp 13. Each of the clamps consists of a fixed jaw 14 and a pivoted jaw 15. The fixed jaw is an integral, extension of the body 11. The pivoted jaw is made integral with the fixed jaw at its upper end by means of a web forming a hinge 16 (FIG. 5). The jaws are held in clamping position by a vertically slidable clip 17 which, when in its lowered position as illustrated, resiliently holds the jaws closed and, when shifted to its raised position, permits the pivoted jaw 15 to be shifted upwardly into open position. This particular construction for a garment hanger is shown and described in the previously referenced U.S. Pat. No. 3,767,092.

To provide this hanger with an auxiliary bar, a pair of sockets 20 are formed in the back face of the fixed jaw, preferably in that part of the jaw which is laterally outside the channel 18 for the clip 17. The socket 20 is preferably formed by means of a mold part which forms a rearwardly extending channel opening through the front face of the fixed jaw (FIG. 11), the latter part of which forms the laterally extending opening 21 into which an end of the auxiliary bar 22 can be inserted (FIGS. 2 and 4). The fact that the socket 20 is formed by an opening extending from the front of the fixed jaw is best seen in FIG. 11.

The auxiliary bar 22 is somewhat U-shaped, having an elongated base portion 23 integral with a pair of upwardly and inwardly inclined end portions 24. The upper ends of the end portions terminate in inwardly extending hinge fingers 30 (FIG. 2). The base portion 23 of the bar is longer than the hanger body 11. Since the clamps 13 are normally secured to the article inwardly of the article's edges, this extra width permits the article to be draped over the base portion without special folding to pass between the end portions 24 (FIG. 1).

Figure 8:
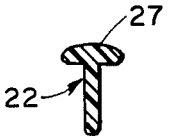
FIG. 8 is a fragmentary sectional view taken along the plane VIII—VIII of FIG. 10.

The auxiliary bar 22 is molded of plastic and throughout all or almost all of the length of its main portion 23 it is of generally T cross-sectional shape to provide sufficient strength and to provide a broad article contacting surface 27 so that the article will not be creased when draped over it (FIGS. 1, 2 and 8).

The hinge finger 30 of the auxiliary bar 22 has a conical head 31 forming its inner end. The head is bifurcated lengthwise by a slot 32 which permits the head to be compressed to pass through the opening 21 of the socket 20. When the conical head has passed entirely through the socket 20 it expands, thereby locking the bar to the hanger body because of contact between the head 31 with the inner face of the socket 20. For this purpose, the loops forming the sockets 20 extend sufficiently rearward to provide room for the outer portion 33 of the head 31 to expand after passing through the socket and seating against the inner face of the socket.

FIG. 6 illustrates the fact that the auxiliary bar and the hook **12*a* can be molded as an integral part of the hanger body 11*a*. Thus, hanger 10*a* is molded with the auxiliary bar 22*a* having the same cross section as the bar 22 but with its upper end integral with and extending laterally outwardly and downwardly from the lower portion of the fixed jaw 14*a*. This arrangement has the advantage of requiring no assembly and, thus, avoids all possibility of being inadvertently disassembled by the user. It also differ from the hangers with the separate bars in that the position of the bar is fixed. In some uses this may be advantageous. However, in other uses the ability of the bar to pivot is desirable to permit the center of gravity of the loaded hanger to adjust with respect to the supporting hook. The hanger 10*a* is illustrated as having an integral molded hook 12*a*. However, it could just as well have a wire hook 12**.

Whether the hanger is of the type illustrated in FIGS. 1–5 or is of the integral bar and body type, the main body of the hanger and, in the case of the hanger illustrated in FIG. 6, the entire hanger is molded of a suitable plastic such as polypropolyene or polystyrene. In the case of the hanger illustrated in FIGS. 1–5, the separate molded bar can be molded of the same or a different plastic material.

FIG. 1 illustrates a typical use of the this type of hanger. An article A, such as a pair of slacks, is secured at the waist by the clamps 13 and the legs folded over the bar 22. If the article, such as a towel, is wider than the bar, it is first folded lengthwise to pass between the end portions 24. Then, because of its length, it is folded back up and draped over the auxiliary bar 22. The bar is supported from the rear face of the clamps 13 and the folded portion of the article is at the rear of the hanger whereby the portion of the article which hangs from the clamps to the first fold serves as a front display panel. In the case of the hangers illustrated in FIGS. 1–5, the auxiliary bar is pivotable in the socket whereby the front to back position of the auxiliary bar will automatically adjust to that which uniformly distributes the weight of the suspended article. In this manner, the hanger provides a convenient, inexpensive and easy to use means of displaying a number of similar or dissimilar articles in a vertical tier from a wall or a post or any other vertical support. In the case of the hangers illustrated in FIGS. 1–5 for purposes of shipment, the auxiliary bar can be pivoted up to lay against the hook, thereby materially reducing the space required for shipment. The same is true if the hangers have to be stored when they are not needed.

Figure 9:
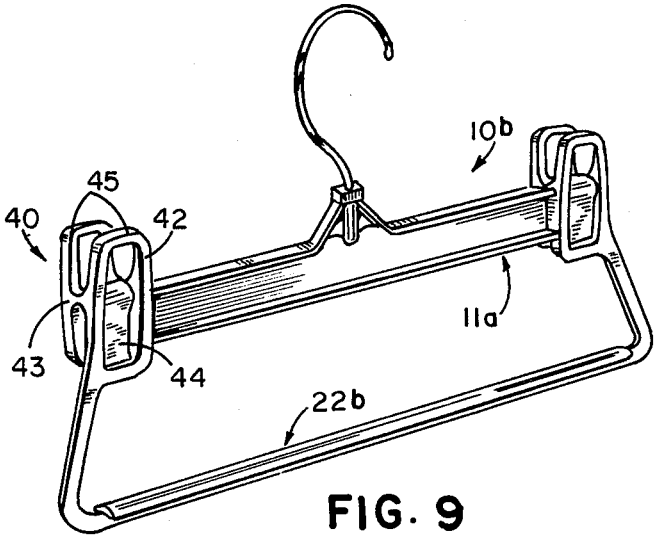
FIG. 9 is a rear oblique view of another modified construction for the hanger.

FIG. 9 illustrates the fact that the invention is not limited to the type of clamping hanger shown in FIGS. 1–6. The hanger **10*b* has pinch clip type clamps 40 at each end of the body. These clips have a pair of jaws 41 and 42 joined at the center by a web 43 which serves as a hinge. The jaws are biased into closed position by the U-shaped spring 44. The jaws can be manipulated by squeezing together the finger grip portions 45 of the jaws. In this construction, only the front jaw 41 pivots, the rear jaw 42 being molded integral with the hanger body 11. The bar 22*b* is identical to the bar 22*a* except for its shape where it is integral with the fixed jaw 42. The body, clamping jaws and bar of the hanger 10*b*** are all molded as a single, integral part from the same plastic materials as the previously described hangers.

Figure 10:
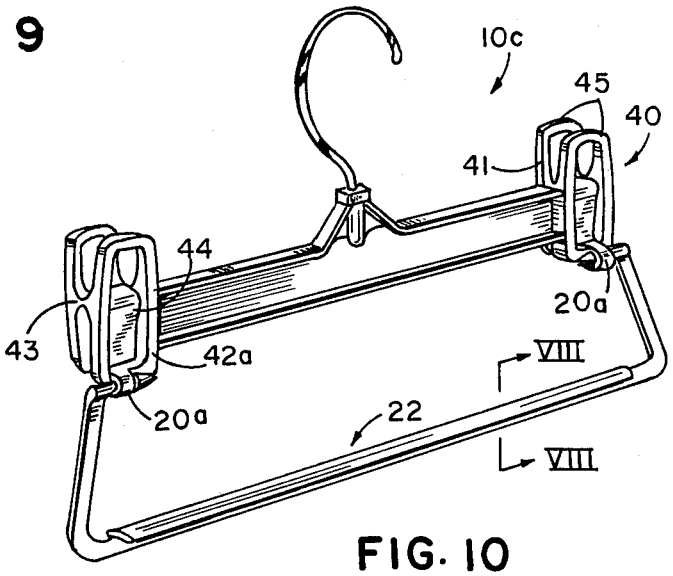
FIG. 10 is a fragmentary rear view of a further modification of the hanger illustrated in FIG. 9.

FIG. 10 illustrates the application of the separate auxiliary bar 22 to the pinch clip type hanger. In this construction, the bar supporting sockets **20*a* are integral with the lower end of the fixed jaw 42*a* and pivotally support the molded plastic type auxiliary bar 22 illustrated in FIGS. 1–4**.

It will also be understood that auxiliary bars of various lengths can be provided, depending upon the width of the articles with which the hanger is to used. Thus, it is possible in the case of the hangers equipped with the separate auxiliary bar formed to provide bars of several primary widths and the hanger adjusted to the particular articles with which it is to be used by substituting bars to provide one of a suitable width. This interchangeability only requires a pair of pliers to squeeze the head 31 to permit removal of the bar with which the hanger is then equipped. In some cases, the hanger, simply by either attaching or removing an auxiliary bar can be adapted for use as either a merchandise display hanger to one for garment display. Thus, the investment in the hanger can be utilized to service both needs.

Having described the preferred embodiment of the invention and modifications thereof, it will be recognized that other modifications can be made without departing from the principles of the invention. Such modifications are to be considered as included in the hereinafter appended claims, unless these claims by their language expressly state otherwise.

We claim:

1. A hanger from which articles can be suspended, said hanger having an elongated molded plastic body and a pair of article clamps one adjacent each end, means intermediate the ends of said body for supporting said hanger from above; each of said article clamps having a pair of jaws one of which is movable and the other stationary, means for urging said movable jaw into closed article gripping position, the improvement in said hanger comprising: a molded plastic U-shaped bar over which an article gripped by said jaws can be folded to provide an auxiliary support therefor, said bar being U-shaped with an elongated central section and a pair of upwardly extending end members; the free ends of said end members having a pair of fingers extending toward each other, a pair of sockets one integral with and extending rearwardly from the back face of each of said stationary jaws; said fingers being rotatable in said sockets; said bar being fabricated of a plastic material having sufficient resiliency to permit the spacing between said fingers to be temporarily changed to permit said fingers to be seated in said sockets.

2. A hanger as described in claim 1 wherein said central section is longer than the spacing between the outer ends of said clamps.

3. A hanger as described in claim 1 wherein said sockets are integral with the lower outer portions of said stationary jaws.

4. A hanger as described in claim 3 wherein said stationary jaw is molded as a shell and said sockets are formed as rearwardly offset portions of said shell, the passage through each of said sockets communicating with the front of said stationary jaw and said fingers being seated against the rear face of said stationary jaw adjacent at least one end of each socket.

5. A hanger from which articles can be suspended, said hanger having an elongated molded plastic body and a pair of article clamps one adjacent each end, means intermediate the ends of said body for supporting said hanger from above; each of said article clamps having a pair of jaws one of which is movable and the other stationary, means for urging said movable jaw into closed article gripping position, the improvement in said hanger comprising: a molded plastic U-shaped bar over which an article gripped by said jaws can be folded to provide an auxiliary support therefor, said bar being U-shaped with an elongated central section and a pair of upwardly extending end members; the free ends of said end members having a pair of fingers extending toward each other, a pair of sockets one integral with and extending rearwardly from the back face of each of said stationary jaws; said fingers being rotatable in said sockets; said bar being fabricated of a plastic material having sufficient resiliency to permit the spacing between said fingers to be temporarily changed to permit said fingers to be seated in said sockets; an enlarged head portion on the inner end of each of said fingers, said head portion having an outwardly facing shoulder, said head having means whereby it can be compressed to pass through one of said sockets, said shoulders seating against the inner ends of said sockets to prevent retraction therethrough.

6. A hanger as described in claim 5 wherein said head has a central slot extending lengthwise thereof to provide said head with compressibility.

7. A hanger as described in claim 6 wherein said head is cone-shaped to facilitate passage through the socket.

* * * * *